United States Patent [19]

Verney

[11] Patent Number: 4,549,871

[45] Date of Patent: Oct. 29, 1985

[54] LIFESAVING RING

[76] Inventor: Darrel E. Verney, W. 3226 Litchfield Pl., Spokane, Wash. 99205

[21] Appl. No.: 604,018

[22] Filed: Apr. 26, 1984

[51] Int. Cl.[4] ..... B63C 9/10

[52] U.S. Cl. ..... 441/81; 441/89; 446/153

[58] Field of Search ..... 441/89, 80, 81, 82, 441/87, 88, 40, 122, 129; 114/267; 446/153

[56] References Cited

U.S. PATENT DOCUMENTS

| | | | |
|---|---|---|---|
| 913,617 | 2/1909 | Busch . | |
| 2,342,868 | 2/1944 | King . | |
| 3,111,696 | 11/1963 | Lo | 441/81 |
| 3,520,008 | 7/1970 | Frieder | 441/81 |
| 4,017,927 | 4/1977 | Massey | 441/81 |
| 4,059,859 | 11/1977 | Hull . | |
| 4,424,043 | 1/1984 | Behl | 441/81 |

FOREIGN PATENT DOCUMENTS

| | | | |
|---|---|---|---|
| 1148181 | 12/1957 | France | 441/81 |
| 68406 | 12/1913 | Switzerland | 441/81 |

*Primary Examiner*—Trygve M. Blix
*Assistant Examiner*—C. T. Bartz
*Attorney, Agent, or Firm*—Wells, St. John & Roberts

[57] ABSTRACT

Disclosed is a lifesaving ring having a buoyant ring means with gripping sections which are sized for convenient grasp in the hand of a thrower. The plurality of gripping sections are preferably each sized differently so that different persons can have a properly sized gripping section for accurate throwing of the lifesaving ring. A grab line is connected about the outer circumference of the lifesaving ring using grab line connectors. Inter-grip sections are positioned between the gripping sections and extend inwardly in order to increase flotation of the lifesaving ring. The gripping sections are preferably color coded for easy identification during times of emergency.

9 Claims, 4 Drawing Figures

LIFESAVING RING

TECHNICAL FIELD

The technical field of this invention is ring buoys, lifesaving rings, or life buoys.

BACKGROUND OF THE INVENTION

Life buoys or lifesaving rings have been used for a number of years on vessels and watercraft, and at swimming or other aquatic areas as a lifesaving device. Prior art lifesaving rings typically included a flotation ring which was approximately circular in shape and had a central aperture. U.S. Pat. No. 913,617 to Busch shows such a ring buoy. The Busch ring buoy also included a lifeline, or grab line as it is usually termed, which is attached about the outer periphery of the ring.

U.S. Pat. No. 4,059,859 to Hull also shows a life ring. The Hull life ring has a main body with a specially shaped ring-like configuration. A rigid secondary ring is attached to the main body in lieu of a grab line such as shown in the Busch patent. The Hull patent is intended to provide an advantageous shape and structural combination allowing the life ring to be thrown more accurately towards the person being saved.

U.S. Pat. No. 2,342,868 to King shows a lifesaving apparatus which includes a flotation ring. The King invention includes a cord or rope wound about the ring. This cord is unwound as the ring spins through the air towards the person being saved.

Despite the advancements indicated by the patents mentioned above, there is a continuing need for a lifesaving ring or ring buoy which can be accurately thrown to a person in trouble.

It is an object of this invention to provide a lifesaving ring which can be thrown very accurately and for a greater distance by a variety of persons having a variety of hand strengths and sizes.

It is an object of this invention to provide a life ring which is economical and easy to construct.

It is an object of the invention to provide a lifesaving ring which is provided with various size gripping segments to accommodate varying hand sizes of individuals who may be throwing the lifesaving ring.

It is a further object of the invention to provide a lifesaving ring which includes varying size hand grips which are provided with color coding so that accurate throwing can occur within a minimum amount of time.

These and other objectives and advantages of the invention will be apparent from the description given herein.

BRIEF DESCRIPTION OF THE DRAWINGS

A preferred embodiment of this invention is illustrated in the accompanying drawings, in which.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
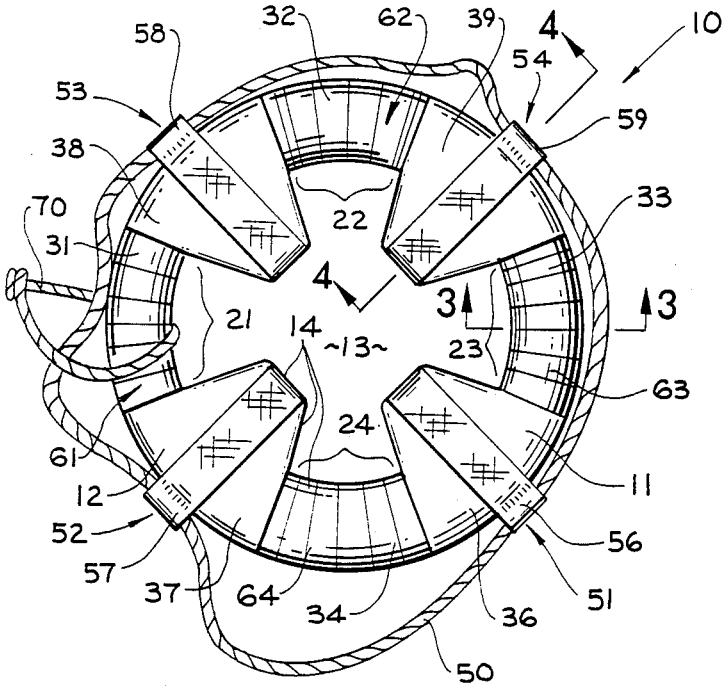
FIG. 1 is a top or plan view of a lifesaving ring according to this invention.
Figure 2:
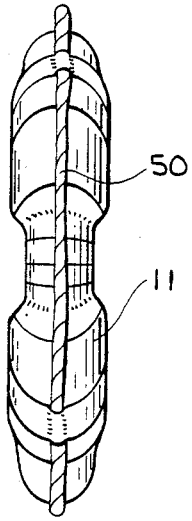
FIG. 2 is an end view showing the lifesaving ring of FIG. 1.
Figure 3:
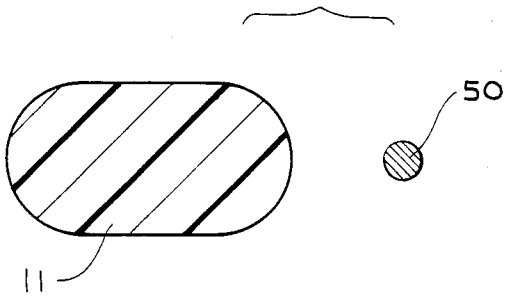
FIG. 3 is a cross-sectional view taken along line 3—3 of FIG. 1.
Figure 4:
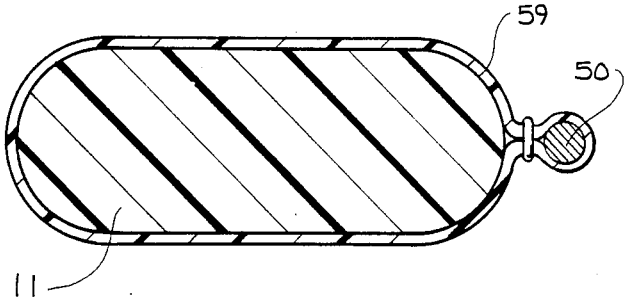
FIG. 4 is a cross-sectional view taken along line 4—4 of FIG. 1.

FIG. 1 shows a preferred embodiment of lifesaving ring 10 according to this invention. Lifesaving ring 10 includes a buoyant ring means 11. Rings means 11 has an outer circumference 12 and a central aperture 13. Central aperture 13 is defined by an inner edge 14 which extends fully about the central aperture 13. Inner edge 14 preferably is shaped in an inner edge profile such as shown in FIG. 1. Such an inner edge profile includes gripping portions 21, 22, 23 and 24 wherein the inner edge is approximately concentric with the outer circumference 12 but spaced inwardly therefrom. Gripping portions 21–24 define gripping sections 31–34 of ring 11, respectively. Gripping sections 31–34 are oblong circular shaped as shown most clearly in FIG. 3. The oblong circular shapes of gripping sections 31–34 are advantageous for accurate throwing. Many alternative shapes such as circular and elliptical are also possible.

Gripping sections 31–34 are properly sized for easy gripping and accurate throwing. Gripping section 31 is the smallest gripping section and preferably has a girth of approximately 18.5 centimeters. Gripping section 33 preferably is the next size larger having an approximate girth of 20 centimeters. Gripping section 32 is the next larger size, having a preferred girth of 21.5 centimeters. The largest gripping section is 34 having a girth of 22.5 centimeters. Clearly these are just suggested gripping section girth sizes and many other suitable sizes and ranges are possible.

Ring means 11 also includes inter-grip sections 36–39. Inter-grip sections 36–39 extend inwardly to increase the overall flotation of the lifesaving ring. The extent to which the inter-grip sections extend inwardly is a matter of design choice and it is conceivable that they could even touch or join together in a spoke-like arrangement. In the preferred embodiment the inter-gripping sections 36–39 are spaced apart from one another to provide the open central aperture 13. Central aperture 13 is preferably large enough so that a person can easily extend one or both arms therethrough when hanging onto the lifesaving ring.

Lifesaving ring 10 also preferably includes a grab line 50 which is connected along the outer circumference 12. Grab line 50 is preferably connected to ring means 11 at connection points 51–54. Connection points 51–54 are preferably positioned within the inter-grip sections 36–39, respectively, of the ring means. Other alternative connection points are also clearly possible.

Grab line 50 is preferably connected to ring means 11 using strong flexible connectors 56–59. Connectors 56–59 are preferably nylon straps which are sewn into a continuous loop about the inter-grip sections and also about and to grab line 50.

Lifesaving ring 10 also preferably includes colored gripping bands 61–64 which are preferably each of a different color in order to provide ready identification of the differently sized gripping sections 31–34, respectively. Colored bands 61 through 64 can be for purposes of illustration be made yellow, green, blue and red, respectively. Colored bands 61–64 can advantageously be constructed of a plastic film which can either be applied through some welding technique or as an adhesively backed tape wrapped about the gripping section a number of times. Such colored tape constructed bands also enhance friction between the thrower's hand and the gripping sections.

Lifesaving rings according to this invention can advantageously be constructed by making the ring means 11 from a foamed closed cell polymer or other resin material which has very high flotation to weight ratio. Such materials are well known in the art. Ring 11 can either be fabricated from one or more pieces of such material or the entire ring can be molded, either at one time or in two or more pieces and then subsequently attached together. Ring means 11 can also be provided with a relatively hard plastic casing (not shown) which prevents breakage of the ring when it strikes water or a hard object.

The lifesaving ring of this invention is preferably used by lifeguards or others who spend at least a small amount of time practicing with the lifesaving ring prior to use in an emergency. Such individuals practice throwing the ring and identify the gripping section 31–34 which has the most advantageous circumferential size for that person's hand grip and throwing technique. Then in time of emergency this person can quickly obtain the ring and grasp it with his or her hand at the appropriate gripping section.

The lifesaving ring of this invention can also be more accurately thrown and at greater distances than conventional ring buoys by even inexperienced persons. The better performance is in part attributed to the gripping sections which allow for tighter gripping and better throwing and release control. Even the largest gripping section is preferably smaller in size than conventional ring buoys.

Although any throwing technique is possible, the person using ring 10 preferably uses an underhand throwing pattern, thereby increasing the accuracy of the lifesaving ring's trajectory as it proceeds towards the person needing assistance. The person receiving the lifesaving ring 10 then grabs the ring means 11 or grab line 50 in order to gain a hold on the lifesaving ring. The ring is then brought closer to the person's body and used in the conventional manner as a flotation support device. A retrieving line 70 is connected about the ring means for retrieving the lifesaving ring.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A hand held, throwable lifesaving ring, comprising:

a buoyant ring means having a continuous approximately circular outer circumference and at least one central aperture extending therethrough;

a plurality of distinct gripping sections and inter-grip sections positioned alternately about the circumference of the ring; the gripping sections being differently sized with respect to other gripping sections; the gripping and inter-grip sections being bounded along adjoining sides thereof by approximately radial abutting surfaces extending inwardly from inner edges of the gripping sections; the cross-sectional shape of the gripping sections having smooth exterior contours sized to be conveniently gripped by various sizes of human hands.

2. The lifesaving ring of claim 1 wherein there is a single central aperture.

3. The lifesaving ring of claim 1 further comprising a flexible grab line connected to the ring means at connection points positioned along the circumference of the inter-grip sections.

4. The lifesaving ring of claim 1 wherein each gripping section is sized differently from the remaining gripping sections.

5. The lifesaving ring of claim 4 further defined by having each of the differently sized gripping sections colored with different colors to thereby color code a gripping size to an easily identifiable color.

6. The lifesaving ring of claim 5 further comprising a flexible grab line connected to the ring means along the circumference thereof at connection points positioned along inter-grip sections between the gripping sections.

7. A hand held, throwable lifesaving ring, comprising:

a buoyant ring means having a continuous circular outer circumference and a central aperture extending therethrough; the central aperture being defined by an inner edge;

a plurality of distinct gripping sections and inter-grip sections positioned alternately about the circumference of the ring; the gripping and inter-grip sections being bounded along adjoining sides thereof by approximately radial abutting surfaces extending inwardly from inner edges of the gripping sections; each gripping section being differently sized from remaining gripping sections; the gripping sections having a smooth oblong cross-sectional shape adapted to comfortably be grasped within the hand of a human.

8. The lifesaving ring of claim 7 wherein the gripping sections are colored differently to provide an easily-identifiable color code for different gripping sizes.

9. The lifesaving ring of claim 8 further comprising a flexible grab line connected about the outer circumference of the ring using flexible strap connectors connected about inter-grip sections of the ring.

* * * * *